United States Patent [19]

Greenbaum

[11] 4,248,000

[45] Feb. 3, 1981

[54] RECEPTACLE TO TRANSPORT AND DISPLAY AN ARTIST'S FRAMED CANVAS

[76] Inventor: Sheldon Greenbaum, 11651 Stoneview Sq., Reston, Va. 22091

[21] Appl. No.: 30,570

[22] Filed: Apr. 16, 1979

[51] Int. Cl.[3] ..... G09F 21/02

[52] U.S. Cl. ..... 40/530; 40/158 R

[58] Field of Search ..... 40/158 R, 530, 367, 40/366, 365, 610, 152, 606, 574, 611

[56] References Cited

U.S. PATENT DOCUMENTS

| | | | |
|---|---|---|---|
| 2,762,148 | 9/1956 | Alcaraz | 40/610 |
| 3,136,082 | 6/1964 | Sloves | 40/530 |
| 3,402,491 | 9/1968 | Wagner | 40/367 |
| 4,038,768 | 8/1977 | Wilson et al. | 40/365 |
| 4,081,119 | 3/1978 | Messmore | 40/610 |
| 4,106,229 | 8/1978 | Schmid | 40/611 |

FOREIGN PATENT DOCUMENTS

| | | | |
|---|---|---|---|
| 2431461 | 12/1975 | Fed. Rep. of Germany | 40/366 |
| 851483 | 10/1960 | United Kingdom | 40/610 |

*Primary Examiner*—Paul J. Hirsch

*Attorney, Agent, or Firm*—Beveridge, DeGrandi, Kline & Lunsford

[57] ABSTRACT

An enclosed device for the safe transport of an artist's freshly painted framed canvas immediately after paint has been applied to the surface of the canvas and before the paint has undergone drying by any natural or artificial means, which device protects the canvas from smearing against the interior sides of the device and provides protection from the natural elements, characterized by an enclosed rectangular receptacle with a handle above for carrying and having a transparent front panel fixed by a flexible hinge along the top of the receptacle so that the transparent panel swings downwards and fastens along the bottom of the receptacle and with the interior of the receptacle fitted with a thin, rigid material slanted on an acute angle, secured at the top and bottom of the receptacle's interior so that the slanted material supports an artist's canvas and prevents forward or lateral movement of the canvas by means of a restraining device along the bottom edge of the slanted material and also prevents forward or lateral movement of the canvas with a clamping device along the top edge of the slanting material; in preferred form there being a horizontal framing member along the top of the receptacle to which the carrying handle is attached on the exterior, the clamping device and top edge of the slanted material are attached on the interior, and that the slanted material is molded, bent, formed or shaped at its lower portion to form the restraining device as one continuous piece.

9 Claims, 7 Drawing Figures

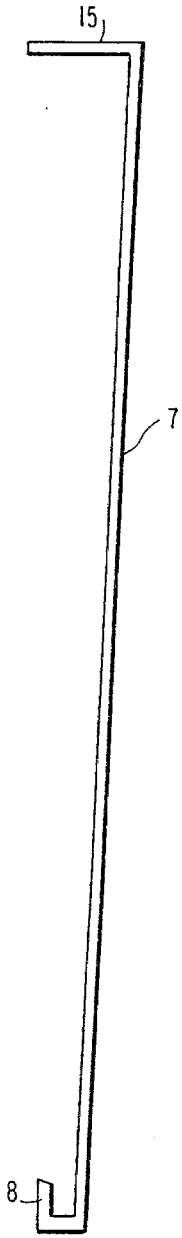
FIG. 3a
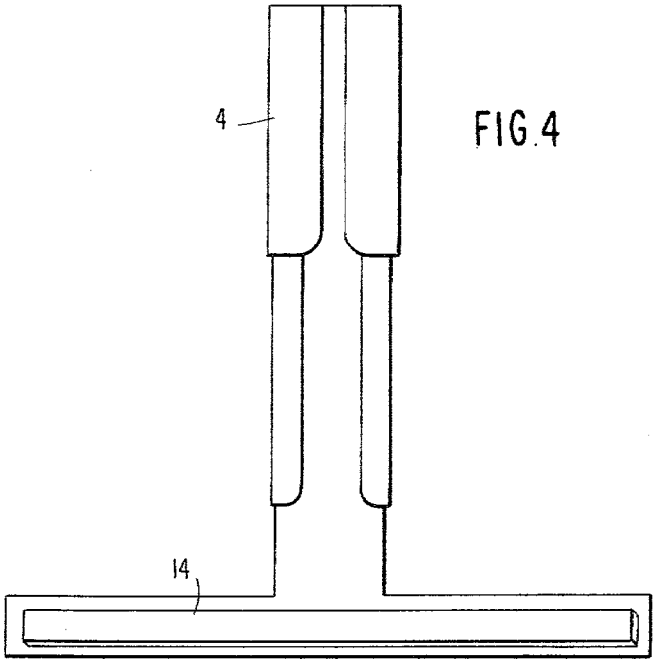
FIG. 4
FIG. 5
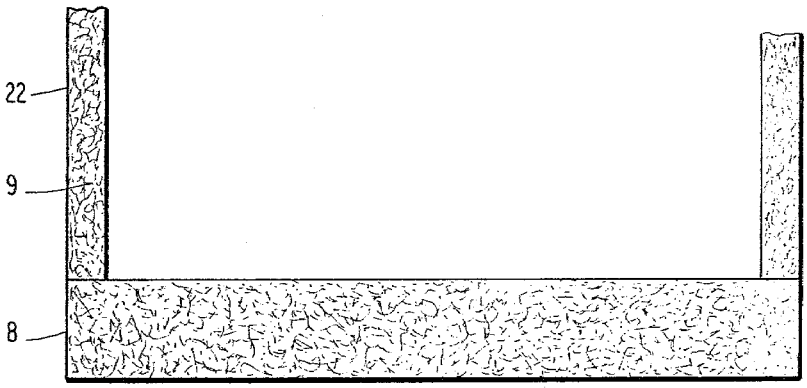
FIG. 6
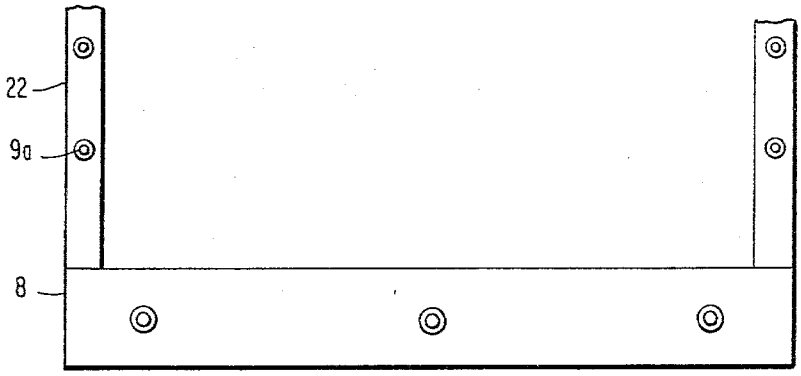

RECEPTACLE TO TRANSPORT AND DISPLAY AN ARTIST'S FRAMED CANVAS

This invention relates to a combined unit for transporting a freshly painted artist's framed canvas which is also conveniently usable as a novel means of displaying a painting while transporting it.

The study of the art of painting is often conducted in a classroom setting on university and college campuses, at continuing education courses, in the private studios of professional artists and at art institutions. The accepted practice is for a student of painting to travel to the place of instruction and to bring all of the necessary supplies and equipment that are required for the lesson. This usually includes tubes of paint pigment, brushes, liquids for mixing, thinning and clean-up, and an artist's canvas stretched on a simple, rectangular wood frame. Some receptacles are commercially available to transport these items and are commonly known as sketch boxes for the paint and brushes, and portfolio cases for the framed canvas. The result of receiving a lesson in the art of painting under presently accepted procedures is a freshly painted artist's canvas, the surface of which is covered with wet paint, and which the student must either transport from the place of instruction while still wet or which the student must leave behind until the next class meeting when sufficient time has elapsed to permit adequate drying by natural means.

When an art lesson is completed, a student usually leaves the wet canvas in a storage locker until the next class meeting. The lockers provided for such a purpose are often poorly constructed, hand-made cabinets making their contents liable to theft, damage or vandalism. Many students have access to these insecure lockers and damages frequently occur to the stored canvases. Art students prefer to take their work with them when a lesson is completed so they can guarantee a safer place of storage for their paintings than is usually present at the place of instruction. If the painting is removed from the place of instruction, they can also have access to the painting so that improvements can be made on it before the next class meeting.

A student choosing to transport the wet canvas from the place of instruction must place it either in a commercially available portfolio case where it is loose and free to move against the interior sides of the portfolio case and become smeared, or the student must carry it exposed in a hand-held manner and still be encumbered by carrying the artist's scketch box and an empty portfolio case.

Transporting a wet canvas without the benefit of a closed receptacle, exposes the painting to the hazards of airborne particles, rain, smearing and dropping in face down. These hazards can combine to damage a painting, to destroy a non-reproduceable effect or cause an emotional loss to the artist.

The present invention has for its principal object the provision of a novel, useful receptacle for transporting and displaying a freshly painted artist's canvas.

Another object is to provide a means of securing the canvas within the interior of the receptacle so as to prevent movement and smearing of the painted surface.

Another object is to provide such a unit with a transparent front panel to enable the artist to observe the condition and position of the canvas during transport and to serve as a method of display thereby promoting the talent of the artist.

A further object is to provide such a unit of economical construction and easily and conveniently usable for securing a freshly painted canvas to its interior and easily manually carried for transporting a freshly painted canvas from a place of instruction. At the same time, such unit has a device permitting ready release and removal of the canvas from the receptacle when desired.

Other objects, features and advantages of the present invention will be apparent from the following description of an embodiment thereof illustrated in the accompanying drawings in which.

FIG. 3*a* shows the continuous nature of the slanted component, removed from the receptacle;

FIG. 4 is a view of the underside of the clamping device showing its capability to extend to variable lengths and its protective padding;

FIG. 5 is a view of the exterior of the restraining edge and the narrow edges of the front of the receptacle to which fastening mechanisms have been attached. FIG. 6 shows alternative closures.

When a student of painting finishes an art lesson at a place of instruction, the canvas upon which the paint has been applied remains wet for several hours. It is common practice for the student to either leave the wet canvas in a storage locker at the place of instruction or to carry it away by hand. Theft, damage, and vandalism occur when the canvas is left in a common storage area shared by other students. If the canvas is removed by the student from the place of instruction before drying occurs, there is a risk of smearing or damage caused by dropping or exposure to the natural elements. Students prefer to keep their canvasses at home as this not only guarantees safety and security but also enables them to work on their art between class sessions. The present invention has a device which permits the artist to transport a freshly painted canvas without damaging it. A person utilizing the receptacle of this invention can remove a wet canvas to any desired location, thereby providing safety and accessibility. Transporting an artist's canvas with the present invention is accomplished by placing the canvas inside the receptacle so that it rests inclined against the angled surface. The bottom of the frame upon which the canvas is stretched is placed behind the restraining edge while the top of the canvas frame is pressed firmly against the angled surface by the clamping device. When the canvas is secured in the receptacle, the transparent panel swings downward and is temporarily affixed to the base and sides of the receptacle. The unit can then be picked up and carried by the handle.

Figure 1:
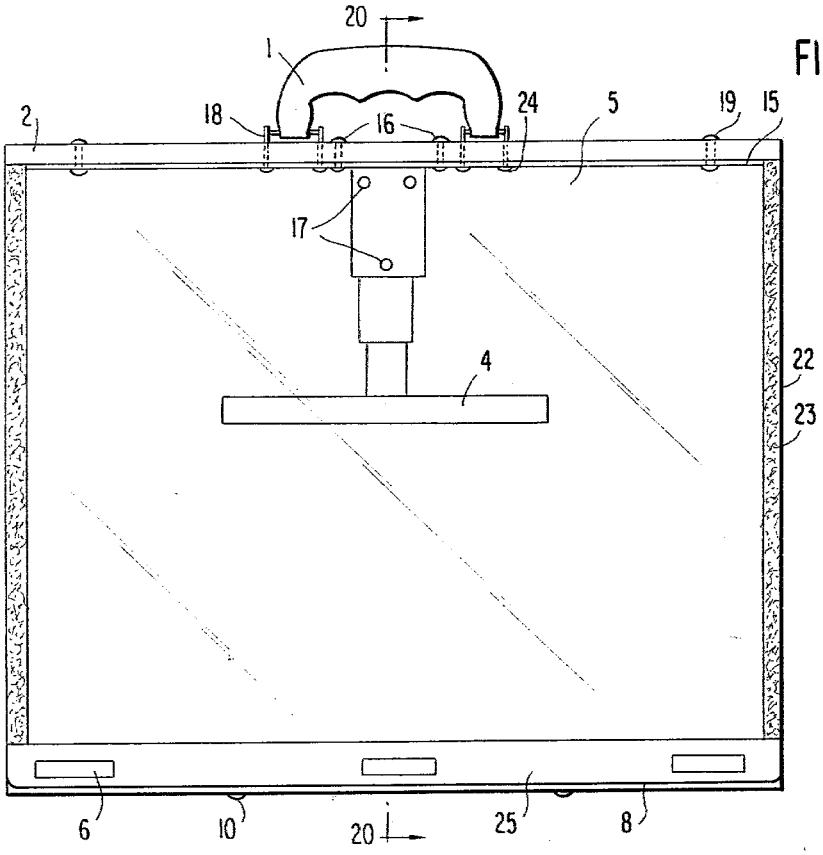
FIG. 1 is a side elevational view showing the clamping device as seen through the transparent panel.
Figure 3:
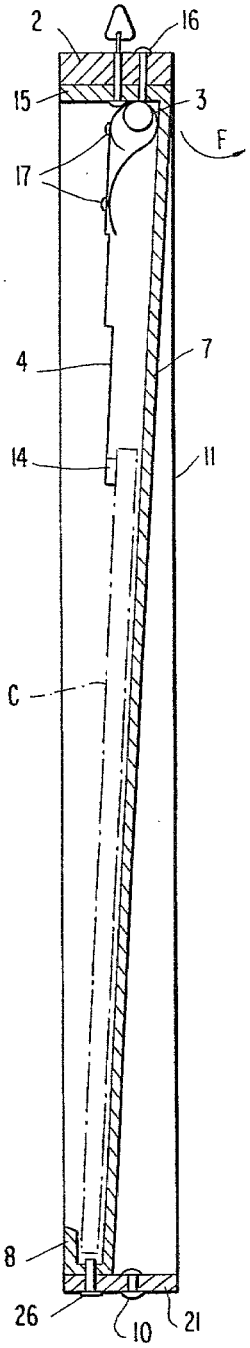
FIG. 3 is a central upright sectional view through the unit substantially along the line 20—20 in FIG. 1 showing the restraining edge of the angled surface and an artist's canvas in phantom illustrating the intended use of the receptacle.
Figure 2:
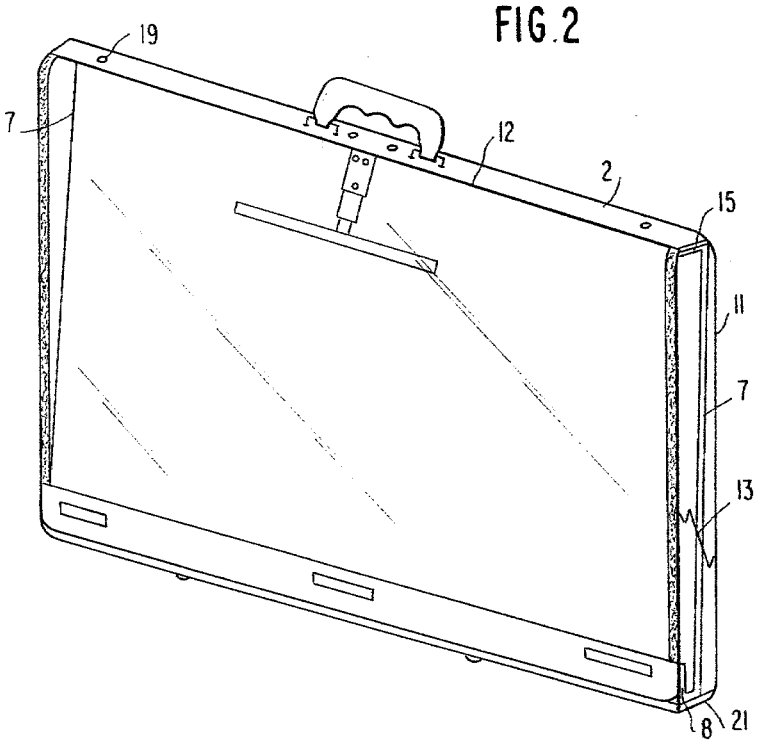
FIG. 2 is a perspective view illustrating the angled surface in a partially broken away section and the flexible hinge upon which the transparent material swings downward.

Referring to FIGS. 1, 2 & 3 of the drawings accompanying this application, the receptacle is made relatively lightweight yet sturdy enough to permit handling and to avoid accidental crushing of the receptacle by a person who might brush against it during its transport from one location to another. An upper horizontal framing member (2) made of wood or other suitable material provides the brace to which the carrying handle (1), the top edge of the angled surface (15) and the clamping device (4) are permanently affixed. The handle (1) is oriented so that it can be secured by rivets (24) and pivot posts (18) or other appropriate fasteners to provide freedom of movement. The clamping device (4) is likewise affixed to the underside of the upper horizontal framing member (2) by rivets or other appropriate fasteners (16) which also pass through the top edge of the angled surface (15) thereby uniting these elements; the top edge of the angled surface (15) is "sandwiched" between the upper horizontal framing member (2) and the clamping device (4). Additional rivets or fasteners (19) at the ends of the framing member (2) provide added support and strength. The clamping device (4) combines with a high-tension spring (3) by means of small rivets or spot welds (17) and a sufficient force is created towards the rear panel of the receptacle (F).

The angled surface (7) is placed entirely within the receptacle which has its back panel and two side panels (11) composed of the flexible, opaque, vinyl portfolio material currently available on the commercial market. The edges of the panels are stitched or seamed together to form an enclosure in accordance with currently accepted methods of manufacture. The lower portion of the angled surface (7) is molded, shaped or bent to form a restraining edge (8) which prevents a canvas, when properly positioned within the receptacle, from moving forward along the bottom plane. The bottom of the receptacle is similarly braced as is the top by a lower horizontal framing member (21) providing a brace to which the restraining edge (8) of the angled surface (7) is permanently secured by means of rivets or other appropriate fastenings (26). Protective metal buttons (10) on the bottom of the receptacle prevent rot, wear and corrosion to the the underside of the portfolio and are likewise affixed to the lower horizontal framing member (21) uniting these elements.

In the preferred embodiment, a piece of heavy, transparent plastic (5) forms the front panel of the receptacle and may be raised or lowered by means of a flexible hinge (12) or fastening installed horizontally on the exterior across the top of the receptacle. When the transparent material (5) is in the closed position, it is temporarily attached to the vertical sides and bottom of the receptacle by means of a closure device (6) which may take the form of snaps, fasteners or interlocking synthetic fabric (Velcro). The vertical panels have narrow widths of portfolio material attached to them at right angles to the vertical panels forming edges or lips (22) to provide surfaces to which the complementary portion of a fastening device, such as Velcro, snaps or fasteners may be affixed by adhesive, stitching or other means.

FIG. 3 illustrates an artist's framed canvas (C), in phantom, held firmly in place with the clamping device (4) in an extended position with pressure applied from the high-tension spring (3), (F). The bottom edge of the canvas (C) remains behind the restraining edge (8) of the angled surface (7). A protective pad or cushion (14) is attached to the underside of the clamping device (4) by means of a commercially available adhesive and prevents scratching or tearing of the painted canvas. For illustration purposes, the angled surface (7) is shown in FIG. 3*a* removed from the interior of the receptacle to show the continuous nature of the top edge (15), the angled surface (7) and the lower restraining edge (8).

In FIG. 4, the protective pad or cushion (14) is attached to the underside of the clamping device (4). The exterior surface of the restraining edge (8) is shown in FIG. 5 with a mechanism to secure the bottom and side portions of the transparent plastic when the plastic material is in its lowered position. This mechanism may be strips of Velcro material (9) affixed to the exterior of the restraining edge (8) and to the edges of the front of the receptacle (22) with an adhesive or it may be snaps or other appropriate fasteners (9*a*), as shown in FIG. 6.

The foregoing detailed description is given for clearness of understanding only and no unnecessary limitations are to be understood therefrom, as modifications will be obvious to those skilled in the art.

I claim:

1. A unit to transport and display an artist's canvas comprising:

an upright receptacle having upper and lower horizontal framing members and two side members, of a size to contain a framed canvas, said receptacle being constructed of flexible, vinyl, portfolio material with a pivoting handle attached to the receptacle and means to prevent movement of the canvas within the interior of the receptacle through the use of an interior angled surface upon which the canvas is fully supported, and having a restraining edge affixed to a lower horizontal member in combination with a padded, extendable clamping means having a high-tension spring and affixed to the upper horizontal member for clamping the canvas against the surface, a front panel of transparent material which swings downward on a flexible hinge to form an enclosed unit when in a lowered position and which forms an entrance or exit opening for the canvas when in a raised or opened position, said transparent panel being secured in a lowered position by means of closure devices installed along the bottom and sides of the receptacle, said transparent panel being able to swing downward along the flexible hinge constructed along the top exterior of the unit, said panel to enable the position and condition of the canvas to be observed during transport.

2. A unit to transport and display an artist's canvas as specified in claim 1 wherein the transparent panel is flexible, heavy strength plastic.

3. A unit to transport and display an artist's canvas as specified in claim 1 wherein the transparent material comprises substantially the entire front panel of the receptacle.

4. A unit to transport and display an artist's canvas as specified in claim 1 wherein the exterior of the bottom restraining edge and the exterior surfaces of the side members on the front of the receptacle are fitted with closure devices to secure the transparent material in place when it is in the lowered position.

5. A unit to transport and display an artist's canvas as specified in claim 1 wherein the interior angled surface has a top edge to which the extendable clamping device, the high tension spring and the upper horizontal framing member are integral.

6. A unit to transport and display an artist's canvas as specified in claim 5 wherein the top edge of the angled surface, the angled surface itself and the bottom restraining edge form one continuous piece.

7. A unit to transport and display an artist's canvas as apecified in claim 1 wherein the upper framing member extends the horizontal length of the receptacle forming a brace to which are attached the pivotable handle, the interior angled surface and the clamping means.

8. A unit to transport and display an artist's canvas as specified in claim 1 wherein the lower framing member extends the horizontal length of the receptacle forming a brace to which are attached the bottom restraining edge of the interior angled surface and protective buttons on the underside of the receptacle.

9. A unit to transport and display an artist's canvas as specified in claim 1 wherein the transparent panel is thin, rigid, heavy-strength plastic.

* * * * *

UNITED STATES PATENT AND TRADEMARK OFFICE

CERTIFICATE OF CORRECTION

PATENT NO. : 4,248,000
DATED : February 3, 1981
INVENTOR(S) : Sheldon Greenbaum

It is certified that error appears in the above—identified patent and that said Letters Patent is hereby corrected as shown below:

IN THE SPECIFICATION:

At column 1, line 50, delete "scketch", and substitute -- sketch --.

At column 1, line 54, delete "in", and substitute -- it --.

Signed and Sealed this

*Twenty-sixth* Day of *May 1981*

[SEAL]

*Attest:*

RENE D. TEGTMEYER

*Attesting Officer* *Acting Commissioner of Patents and Trademarks*